US006180895B1

(12) United States Patent
Hutchinson et al.

(10) Patent No.: US 6,180,895 B1
(45) Date of Patent: Jan. 30, 2001

(54) KEYPAD

(75) Inventors: Mark Hutchinson, Bordon; Tony Horne, Basignstoke, both of (GB)

(73) Assignee: Nokia Mobile Phones Limited, Espoo (FI)

( * ) Notice: Under 35 U.S.C. 154(b), the term of this patent shall be extended for 0 days.

(21) Appl. No.: 09/466,188

(22) Filed: Dec. 17, 1999

(30) Foreign Application Priority Data

Dec. 18, 1998 (GB) ..... 9828024

(51) Int. Cl.[7] ..... K01H 13/70

(52) U.S. Cl. ..... 200/5 A; 200/517; 200/341; 200/314

(58) Field of Search ..... 200/5 R, 5 A, 200/512, 517, 310, 313, 314, 317, 341, 343–345; 400/472, 490, 491, 491.2, 495, 495.1, 496

(56) References Cited

U.S. PATENT DOCUMENTS 4,163,138 * 7/1979 Harden ..... 200/310
4,323,740 4/1982 Balash ..... 200/5 A
5,568,367 * 10/1996 Park ..... 362/109
5,570,114 * 10/1996 Fowler ..... 345/173
5,747,756 * 5/1998 Boedecker ..... 200/5 A
5,847,336 * 12/1998 Thornton ..... 200/5 A
5,892,192 * 4/1999 Ishiguro et al. ..... 200/5 R

FOREIGN PATENT DOCUMENTS 0500330 8/1992 (EP) ..... H01H/13/70
0503198 9/1992 (EP) ..... H01H/13/70

* cited by examiner

*Primary Examiner*—Michael Friedhofer
(74) *Attorney, Agent, or Firm*—Antonelli, Terry, Stout & Kraus, LLP

(57) ABSTRACT

A keypad assembly is disclosed, which includes a keymat, a switch assembly, and an intermediate element positioned between the keymat and the switch assembly. The intermediate element is configured to provide an aperture associated with a key of the keymat, and a resilient member is attached to the intermediate element, and extends into the aperture. Pressure on a key of the keymat is transferred via the resilient member to a key dome of the switch assembly.

12 Claims, 4 Drawing Sheets

KEYPAD

BACKGROUND OF THE INVENTION

The present invention relates to a keypad assembly having particular, but not exclusive, application in the field of portable radiotelephones.

Some driving forces behind the design of keypads are mechanical reliability, reliability of operation, reduced cost and efficiency of manufacture.

Keypads are used in the user interfaces of devices such as calculators and radiotelephones (e.g. mobile phones). One design of keypad is shown in cross-section in FIG. 1. There is a flexible rubber keymat 1 which has key portions 2 surrounded and joined to the main web of the keymat by resilient deformation zones 3. Each key portion has an upper region 4 which projects through a corresponding hole 5 in an outer housing 6 of the device, and a lower region 7 which terminates in a projection 8. The upper portion can include in-moulded or printed indicia 9 to allow a user to identify the key. When a user presses the upper region 4 of the key the resilience of the deformation zone surrounding the key allows the key to travel towards a switch assembly 10 associated with the key so that the projection 8 can engage the switch. When the key portion is released the deformation zone urges it to return to its original position as illustrated in FIG. 1. The switch assembly comprises an upper assembly 11, including a flexible dome 12 made of sheet material, and a lower assembly 13 comprising a circuit board 14 with exposed conductive tracks 15. When the key is pressed it urges the dome 12 to deform suddenly to the configuration illustrated at 12*a* or 12*b,* in which it bridges the conductive tracks 15 of the switch assembly and connects them together electrically. This connection is sensed by the device. When the key is released the dome returns to its natural state, disconnecting the tracks from each other. The sudden deformation of the dome provides a user with a pleasant tactile and/or aural feedback when a key is pressed.

Such keypads are widely used, but are expensive, and they suffer from the problem that the printing 9 on the surface of the key is prone to wear and tear and may become unreadable over time.

There has been an increased usage in recent times of so-called in-mould keymats. Specific types of in-mould keymats are termed film-on-plastic and film-on rubber, in reference to their constituent parts. These differ from the keymats described above in that the keymat starts as a planar sheet onto which the final markings of the keys, i.e. the text to appear thereon, is indelibly printed or etched. This has the advantage that the markings do not suffer so greatly from the wear and tear problems associated with more traditional rubber keymats.

The planar sheet is then selectively vacuum or heat formed in parts such that the keys are made to stand proud of the surrounding material. The spaces thus created behind the keys need to be filled with a solid material so that the keys may be used to exert pressure on a key dome 12, and hence actuate the switch 10, as in the previously described solution. This can be achieved in a number of ways, but a particularly suitable method uses injection moulding techniques to fill the spaces with a suitable solid material, such as rubber or plastics.

A problem with this solution is that if the rubber keymat is directly replaced by the in-mould variety, the keymat does not benefit from the resilient deformation zones 3. This is because the in-mould keymat is relatively rigid, and there is not so great a degree of mechanical independence between adjacent keys. This results in a tendency for pressure on a given key to drag down its neighbour, which can result in unwanted key presses. This in turn may lead to incorrectly dialled telephone numbers, for instance.

Another problem with the in-mould keymat is that the keystroke, i.e. the distance travelled by the key from its rest position to the point at which the circuit is completed, is only of the order of 0.2 mm. With traditional rubber keymat solutions, the compression of the rubber material and the resilient deformation zones contribute to a keystroke of approximately 1 mm. This distance feels pleasing to the user, whereas the 0.2 mm for the in-mould keymat gives something of a hair-trigger feel, and does not afford such a good tactile solution.

In addition, the two problems mentioned above can combine such that erroneous key presses can occur through pressure on the casing of the apparatus, particularly the front casing 6 of the apparatus, enclosing the keymat.

SUMMARY OF THE INVENTION

According to a first aspect of the present invention, there is provided a keypad assembly including: a keymat; a switch assembly; and an intermediate element having at least one aperture positioned between a key of the keymat and a switch of the switch assembly, wherein a resilient member extending from the intermediate element into the aperture is disposed between said key and said switch.

The keypad advantageously affords to a user a greater degree of tactility in its use. This is because the user has to move a key through a greater distance than would be the case if an in-mould type keymat were used to directly actuate a key-dome type switch. This increased keystroke provides feedback to the user, and may help to convince him that he has successfully completed a keying operation.

Advantageously, the intermediate element, known as a C-cover, also assists in providing a greater degree of mechanical independence between neighbouring keys. Raised portions surrounding the apertures in the C-cover coincide with the edges of corresponding apertures in the front cover, or A-cover, of the telephone. These raised portions encircle each aperture, and the bracing therein provided helps to enable individual keys to operate independently of one another.

Further, the C-cover can be constructed to operate as a light-guide. This particular function is achieved by the selection of a material which allows light to be transmitted through it by the process of total internal reflection. One or more LED's are provided, and the light therefrom is channelled through the C-cover to illuminate each key from beneath, thus allowing use of the keypad in conditions of poor lighting.

According to a second aspect of the present invention, there is provided an intermediate element for use in a keypad assembly having a key or array of keys overlying a switch or array of switches of a switch assembly, including: a substantially rigid body having an aperture, or array of apertures, corresponding to the switch, or the array of switches, of the switch assembly, wherein a resiliently flexible member extends into the or each aperture.

BRIEF DESCRIPTION OF THE DRAWINGS

For a better understanding of the present invention, and to understand how the same may be brought into effect, reference will now be made, by way of example only, to the appended drawings in which.

DETAILED DESCRIPTION

Figure 1:
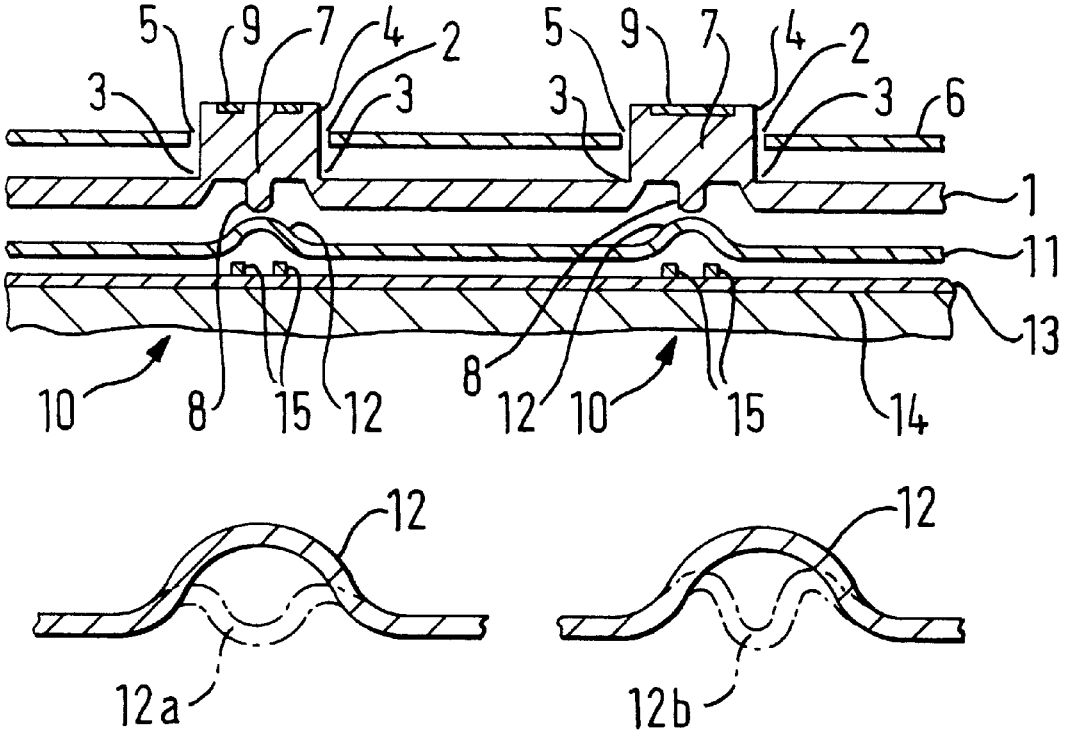
FIG. 1 PRIOR ART
FIG. 1 shows a rubber keymat and associated switch assembly according to the prior art.
Figure 2:
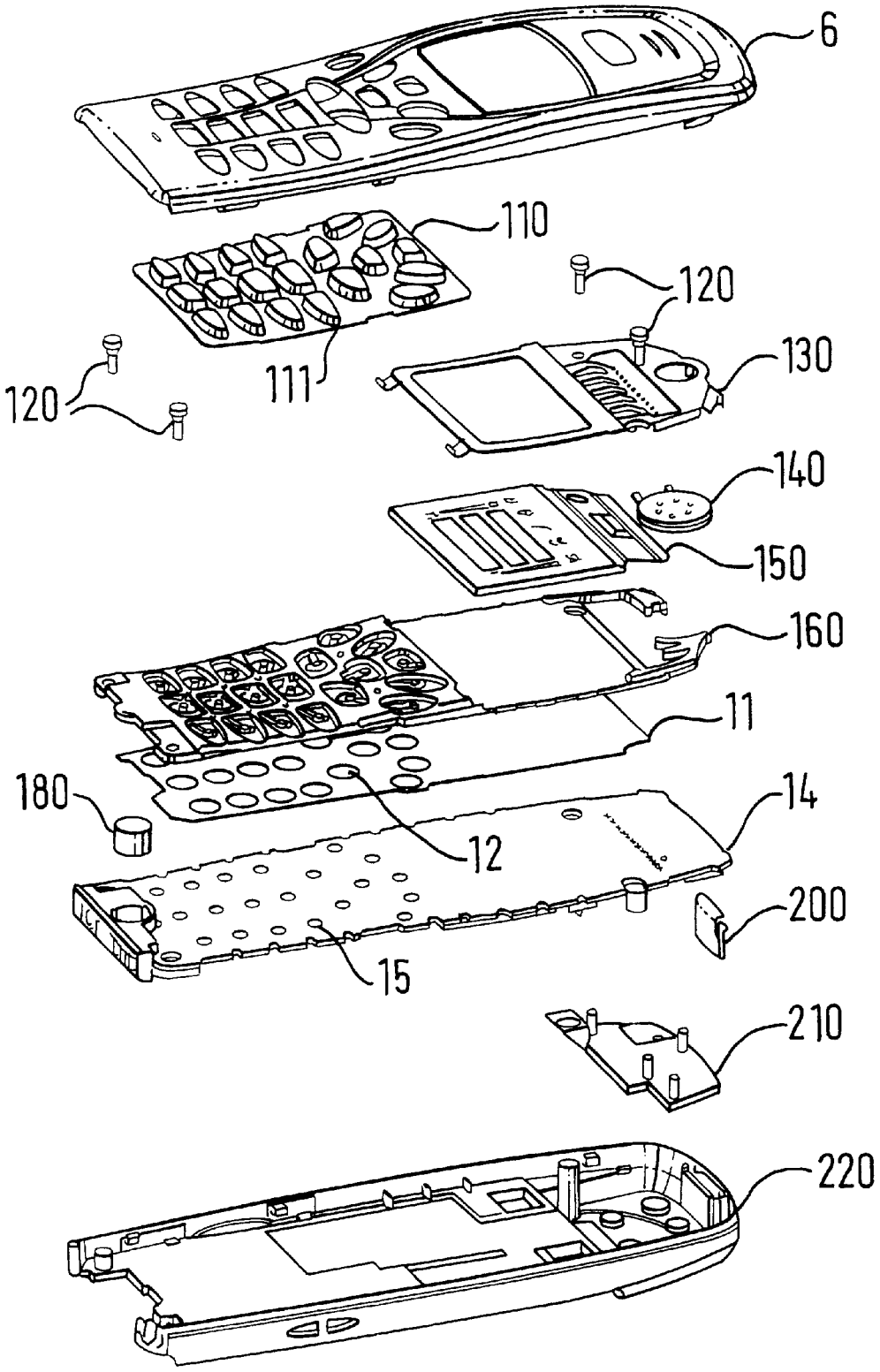
FIG. 2 shows an exploded view of some of the components of a portable radiotelephone incorporating an embodiment of the invention.

With reference to FIG. 2, some of the various components which make up a portable radiotelephone can be identified. These include: Front cover (also known as the A-cover) 6, in-mould keymat 110, retaining screws 120, display clamp 130, speaker 140, display 150, C-cover incorporating light-guide and key dome actuators 160, key dome switch assembly 11, microphone 180, printed circuit board (PCB) 14, retaining clip 200, internal antenna module 210 and rear cover (also known as B-cover) 220. The battery (not shown) clips onto the rear of the telephone, specifically onto the rear cover 220.

FIG. 2 shows how the in-mould keymat 110 is positioned in relation to the front cover 6 and the key dome switch assembly 11. The position of the intermediate C-cover 160 is also shown.

Figure 3:
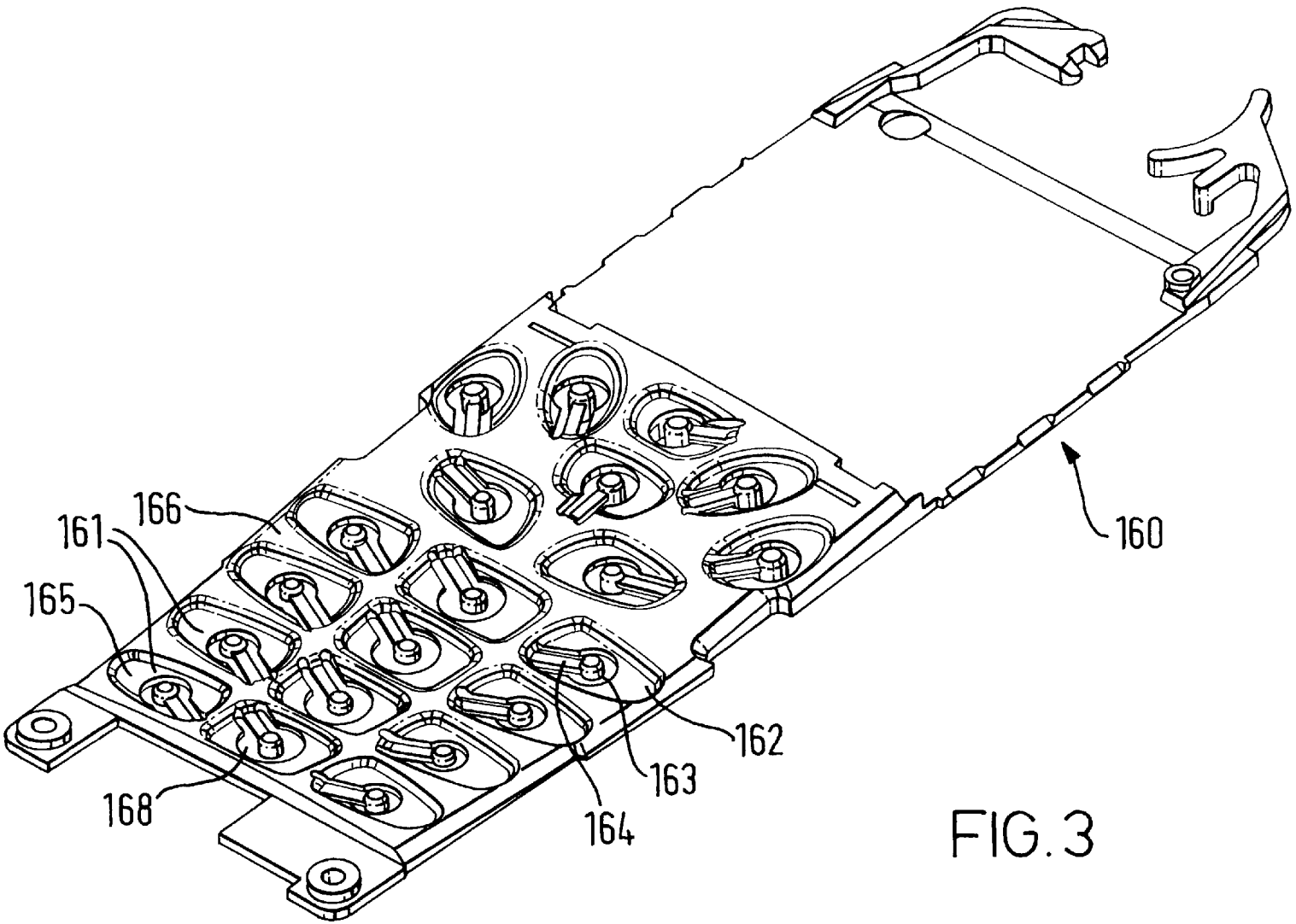
FIG. 3 shows a close up of a C-cover according to the invention, which sits between the keymat and the switch assembly.

FIG. 3 shows in more detail the so-called C-cover 160 which sits between the in-mould keymat 110 and the key dome switch assembly 11. The C-cover is constructed from relatively rigid plastic, and may be formed by any suitable process, for example, moulding or milling. The C-cover has an arrangement of separate hollows 161 in its body and each hollow 161 is substantially similar in size and shape to the keys 111 of the in-mould keymat 110. By comparing the configuration of the C-cover 160 with the in-mould keymat 110, a direct relationship between the positions of the arrangement of the individual keys 111 of the in-mould keymat 110, and hollows 161 can be ascertained. This relationship is also expressed in the positions of the apertures of the front cover (A cover) 6, the positions of the key domes 12 in the key dome switch assembly 11, and in the positions of the conductive tracks 15 on the PCB 14.

Each of the hollows 161 has surrounding sidewall portions which rise from a planar base portion 165 to raised portions 166 separating adjacent hollows 161. In a hollow 161, the planar base portion 165 extends between the sidewall portions. The raised portions 166 are arranged such that they effectively surround and isolate each of the hollows 161. An aperture 168 is defined in the base portion 165 of each hollow 161 and allows communication through the C-Cover 160. The aperture is key-hole shaped. It extends from the sidewall of the hollow 161 and terminates in a substantially circular portion at the centre of the base portion 165. In each hollow 161, a flexible member 162 is attached to the sidewall of the hollow and is supported within the keyhole shaped aperture 168 in the base of the hollow 161. The member 162 is integral with the body of C-cover 160 and comprises an arm portion 164 and a head portion 163, and somewhat resembles a hammer in shape. The arm 164 is in the plane of the body of the C-cover 160 and is resiliently flexible. The head 163 is located when in equilibrium within the substantially circular portion of the aperture 168 and has an extension perpendicular to the arm 164. Even though the plastic from which the C-cover 160 is formed is relatively rigid, the member 162 can be made sufficiently flexible through its careful dimensioning.

Assembly requires the antenna module 210 to be inserted into rear cover 220. Microphone 180 is then inserted into a connector attached to PCB 14 which is then placed into rear cover 220. The key dome assembly 11 sits on top of the PCB 14. C-cover 160 is then placed on top of the key dome assembly 14, before the display 150, loudspeaker 140 and associated clamp 130 are attached. All these components are firmly held in place with the screws 120. The final stage of assembly requires the in-mould keymat 110 to be inserted into front cover 6 before the front cover is attached to the remainder of the telephone and retained firmly in place by clip 200.

Figure 4:
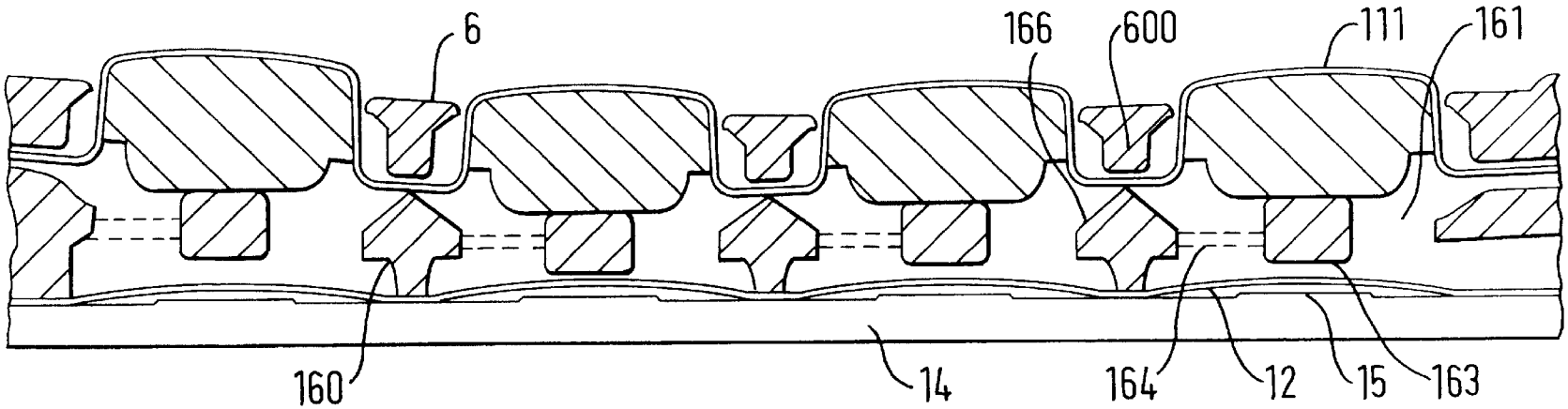
FIG. 4 shows a cross-section through part of the radiotelephone of FIG. 2.

Once assembled, the structure of the keypad part of the telephone is as shown in cross-section in FIG. 4. This shows that key 111 of the in-mould keymat 110 is positioned above the upper surface of head 163 of resilient member 162. Lower surface of head 163 of resilient member 162 is in turn positioned above the key dome 12 and PCB contacts 15. The dotted line of resilient member 162 indicates the position of the arm portion 164 of the resilient member joining the head 163 to the main structure of the C-cover 160 which is not otherwise visible in the particular cross-section shown.

In operation, pressure on key 111 is transferred to the head 163 of the resilient member 162. The arm portion 164 of resilient member 162 pivots about its fixed end in the manner of a cantilever, and the head 163 at the free end is caused to move towards the key dome 12. Continued pressure causes key dome 12 to deform and thus complete the circuit formed by conductive tracks 15 on the PCB 14 below the key dome switch assembly 11. The removal of pressure from key 111 results in resilient member 162 returning to its rest position, and key dome 12 consequently reforming to its rest shape, thus breaking the circuit at PCB contacts 15.

The net result of this arrangement is that the keystroke is considerably increased above that which could be achieved using the in mould keymat contacting the key dome switch assembly directly. As can be seen from FIG. 4, the key 111 must travel a short distance before the head 163 of the resilient member 162 connects with the key dome 12, causing it to deform and thus complete the circuit 15.

The C-cover 160 also helps to mechanically isolate the keys from each other. FIG. 4 shows how the raised portions 166 of the C-cover 160 brace against similar isolating structures 600 forming part of the front cover 6 of the telephone. This effectively clamps the non-raised parts in between the keys 111 of the in-mould keymat 110, thus encircling each key and isolating it from its neighbours. This arrangement helps to ensure that pressure on a given key is not transferred to its neighbours. This results in there being less likelihood of dragging down a neighbouring key, resulting in erroneous input.

Since the keys can effectively be made mechanically independent, this arrangement also helps to prevent pressure on the casing causing inadvertent key presses.

The C-cover, in this embodiment, is made of a relatively transparent plastic material. This allows the C-cover to further function as a light-guide. i.e. it assists in illuminating the keypad for use in times of poor external illumination. The light sources, e.g. LEDs, are distributed at convenient points around the keypad, and the plastic material, utilising the effects of total internal reflection, guides the light to individual keys. Even though the in-mould keymat is manufactured to be filled with either a rubber or plastic material, it is sufficiently translucent to allow enough light to shine through the keys for the user to be able to identify them easily in darkened operating conditions.

In view of the foregoing description it will be evident to a person skilled in the art that various modifications may be made within the scope of the invention.

In particular, alternative configurations for the resilient member may be envisaged. For instance, rather than being anchored at only one end, it could be anchored at both ends, but flexing somewhere along its length. This would still provide a means by which pressure from a user's finger may be transferred to a key dome.

Although described in terms of application to a portable radiotelephone, the skilled man would immediately realise that the keypad herein described could be used in any apparatus requiring a keypad for data entry.

The present invention includes any novel feature or combination of features disclosed herein either explicitly or any generalisation thereof irrespective of whether or not it relates to the claimed invention or mitigates any or all of the problems addressed.

What is claimed is:

1. A keypad assembly comprising:

a keymat;

a switch assembly; and an intermediate element having at least one aperture positioned between a key of the keymat and a switch of the switch assembly, wherein a resilient member extending from the intermediate element into said at least one aperture is disposed between said key and said switch, and wherein said resilient member is disposed above said switch such that said key when actuated travels a distance before contacting said switch using said resilient member.

2. A keypad assembly as claimed in claim 1 further comprising:

a cover for retaining the keymat, wherein the cover and the intermediate element cooperate to increase mechanical independence of the key of the keymat.

3. A keypad assembly as claimed in claim 1 wherein the resilient member is fixed at one end only.

4. A keypad assembly as claimed in claim 3, wherein the resilient member comprises a projection at an end other than the fixed end.

5. A portable radiotelephone comprising a keypad assembly according to claim 1.

6. A keypad as claimed in claim 1, further comprising a cover for retaining the keymat, wherein raised portions surrounding said at least one aperture of the intermediate element abut against raised portions of the cover.

7. A keypad assembly as claimed in claim 1, wherein the intermediate element is constructed of a transparent material to channel light from a discrete source to illuminate said key of the keymat.

8. A keypad comprising:

a keymat;

a switch assembly;

an intermediate element having at least one aperture positioned between a key of the keymat and a switch of the switch assembly, wherein a resilient member extending from the intermediate element into said at least one aperture is disposed between said key and said switch; and a cover for retaining the keymat, wherein raised portions surrounding said at least one aperture of the intermediate element abut against raised portions of the cover.

9. A keypad assembly comprising:

a keymat;

a switch assembly; and an intermediate element having at least one aperture positioned between a key of the keymat and a switch of the switch assembly, wherein a resilient member extending from the intermediate element into said at least one aperture is disposed between said key and said switch, and wherein the intermediate element is constructed of a transparent material to channel light from a discrete source to illuminate said key of the keymat.

10. An intermediate element for use in a keypad assembly having a key overlying a switch of a switch assembly, comprising:

a substantially rigid body having an aperture corresponding to the switch of the switch assembly, wherein a resiliently flexible member extends into the aperture and is disposed between said key and said switch, and wherein said resiliently member is disposed above said switch such that said key when actuated travels a distance before contacting said switch using said resilient member.

11. An intermediate element as claimed in claim 10, wherein said intermediate element is constructed from a dependent transparent material.

12. An intermediate element for use in a keypad assembly having a key overlying a switch of a switch assembly, comprising:

a substantially rigid body having an aperture corresponding to the switch of the switch assembly, wherein a resiliently flexible member extends into the aperture, wherein said intermediate element is constructed from a transparent material.

* * * * *

UNITED STATES PATENT AND TRADEMARK OFFICE

CERTIFICATE OF CORRECTION

PATENT NO. : 6,180,895 B1
DATED : January 30, 2001
INVENTOR(S) : Mark Hutchison et al.

It is certified that error appears in the above-identified patent and that said Letters Patent is hereby corrected as shown below:

Title page,
Item [75], Inventors, replace "Hutchinson" with -- Hutchison --.

Signed and Sealed this

Nineteenth Day of March, 2002

*Attest:*

*Attesting Officer*

JAMES E. ROGAN
*Director of the United States Patent and Trademark Office*